US006074312A

United States Patent [19]

Lyon et al.

[11] Patent Number: 6,074,312

[45] Date of Patent: Jun. 13, 2000

[54] GOLF HANDICAP SYSTEM AND METHODS

[75] Inventors: Lawrence G. Lyon, Red Feather Lakes; Steven K. Suttman, Highlands Ranch, both of Colo.

[73] Assignee: Dynamic Solutions International, Englewood, Colo.

[21] Appl. No.: 08/922,886

[22] Filed: Sep. 3, 1997

Related U.S. Application Data

[60] Provisional application No. 60/053,943, Jul. 28, 1997.

[51] Int. Cl.[7] ..... G06F 15/44

[52] U.S. Cl. ..... 473/409; 463/29; 700/91; 235/375

[58] Field of Search ..... 463/1, 29, 40–43, 463/30, 25; 473/407, 409, 131; 235/375, 380, 382, 78 G, 88 G; 340/323 R; 700/90–91

[56] References Cited

U.S. PATENT DOCUMENTS

| | | | |
|---|---|---|---|
| 4,102,493 | 7/1978 | Moreno | 235/419 |
| 4,268,744 | 5/1981 | McGeary | 235/375 |
| 4,319,131 | 3/1982 | McGeary et al. | 235/375 |
| 4,650,981 | 3/1987 | Foletta | 235/449 |
| 4,672,182 | 6/1987 | Hirokawa | 235/436 |
| 4,701,600 | 10/1987 | Beech et al. | 235/375 |
| 4,764,666 | 8/1988 | Bergeron | 235/380 |
| 4,874,935 | 10/1989 | Younger | 235/492 |
| 4,910,677 | 3/1990 | Remedio et al. | 364/410 |
| 4,918,631 | 4/1990 | Hara et al. | 364/708 |
| 5,068,521 | 11/1991 | Yamaguchi | 235/492 |
| 5,095,430 | 3/1992 | Bonito et al. | 364/410 |
| 5,122,643 | 6/1992 | Gamou et al. | 235/384 |
| 5,175,424 | 12/1992 | Lisimaque | 235/492 |
| 5,179,517 | 1/1993 | Sarbin | 463/29 |
| 5,191,192 | 3/1993 | Takahira et al. | 235/375 |
| 5,241,160 | 8/1993 | Bashan et al. | 235/380 |
| 5,241,161 | 8/1993 | Zutu | 235/382 |
| 5,293,424 | 3/1994 | Holtey et al. | 380/23 |
| 5,319,548 | 6/1994 | Germain | 473/407 |
| 5,349,173 | 9/1994 | Scheckel et al. | 235/492 |
| 5,357,091 | 10/1994 | Ozawa et al. | 235/380 |
| 5,367,150 | 11/1994 | Kitta et al. | 235/380 |
| 5,378,887 | 1/1995 | Kobayashi | 235/492 |
| 5,382,778 | 1/1995 | Takahira et al. | 235/380 |
| 5,418,353 | 5/1995 | Katayama et al. | 235/380 |
| 5,429,361 | 7/1995 | Raven | 463/29 |
| 5,459,304 | 10/1995 | Eisenmann | 235/380 |
| 5,471,191 | 11/1995 | Narita | 340/323 R |
| 5,504,312 | 4/1996 | Morrison et al. | 235/375 |
| 5,536,010 | 7/1996 | Lambourne | 364/411 |
| 5,562,550 | 10/1996 | Chartrand | 473/131 |
| 5,629,508 | 5/1997 | Findley, Jr. et al. | 235/38 R |
| 5,779,549 | 7/1998 | Walker et al. | 463/42 |
| 5,949,679 | 9/1999 | Born et al. | 463/42 |

FOREIGN PATENT DOCUMENTS

WO98/29829 7/1998 WIPO .

OTHER PUBLICATIONS

*Business Wire*, Nov. 13, 1996, 8:29 AM EST, The PointCast Network™, "Unisys score $8.5 Million Australian Golf Contract".

*Way Points*, Spring 1997, "SMP Server Stars in $8.5 Milion Australian Golf Contract".

*Primary Examiner*—Mark A Sager

*Attorney, Agent, or Firm*—Townsend and Townsend and Crew LLP

[57] ABSTRACT

The invention provides systems and methods for the calculation and maintenance of a golfer's handicap index. In one exemplary embodiment, a method is provided for the maintenance of a golf handicap index by providing a card having golfer information relating to a particular golfer. The golfer information includes scores posted by the golfer which are used in the calculation of a handicap index. A local processing unit is also provided to compute the handicap index based on guidelines established by the United States Golf Association. Information is exchanged between the card and the local processing unit at the time the golfer posts a score. Handicap indexes are updated based at least in part on the entered scores and on a schedule consistent with USGA guidelines.

45 Claims, 15 Drawing Sheets

| Date | Score | Adjusted Course Rating | USGA slope Rating | Handicap Differential |
|---|---|---|---|---|
| 7/17/97 | 87 | 70.0 | 125 | 15.4 |
| 7/16/97 | 87 | 70.0 | 125 | 15.4 |
| 7/16/97 | 78 | 70.0 | 125 | * 7.2 |
| 7/16/97 | 87 | 72.0 | 130 | 13.0 |
| 7/16/97 | 78 | 69.0 | 120 | * 8.5 |
| 7/16/97 | 87 | 70.0 | 125 | 15.4 |
| 7/16/97 | 78 | 69.0 | 120 | * 8.5 |
| 7/11/97 | 83 | 73.0 | 142 | * 8.0 |
| 7/11/97 | 86 | 73.0 | 142 | 10.3 |
| 7/09/97 | 78 | 68.0 | 120 | * 9.4 |
| 7/03/97 | 76 | 73.0 | 142 | * 2.4 |
| 7/01/97 | 77 | 73.0 | 142 | * 3.2 |
| 7/01/97 | 84 | 73.0 | 142 | * 8.8 |
| 7/01/97 | 78 | 69.9 | 132 | * 6.9 |
| 7/01/97 | 82 | 73.0 | 142 | * 4.0 |
| 7/01/97 | 79 | 69.9 | 132 | 10.4 |
| 6/26/97 | 87 | 67.3 | 123 | 10.7 |
| 6/26/97 | 83 | 73.0 | 142 | 11.1 |
| 6/25/97 | 87 | 67.3 | 123 | 14.4 |
| 6/25/97 | 79 | 69.0 | 124 | 16.4 |

GOLF HANDICAP SYSTEM AND METHODS

CROSS-REFERENCE TO RELATED APPLICATIONS

This application claims benefit from U.S. Provisional Patent Application filed Ser. No. 60/053,943, filed Jul. 28, 1997, the complete disclosure of which is herein incorporated by reference.

BACKGROUND OF THE INVENTION

This invention relates generally to the field of golf, and in particular to a golf handicap system. More particularly, the invention provides an improved computerized golf handicap system.

In the United States, many active golfers are members of golf country clubs or other golfing associations which employ the use of a handicap index card. Such a handicap index card is issued to each club member and includes the golfer's handicap index. In this way, when golfers compete against each other, the handicap index is used to promote a competitive environment.

Throughout most of the United States, such handicap index cards are issued by the United States Golf Association (USGA) through various local associations, typically by state golf associations. The system employed by the USGA to regularly update the handicap indexes for all of its members is the Golf Handicap Information Network (GHIN). One major non-participant of this system is the Southern California Golf Association (SCGA) which employs the Integrated Data Corporation (IDC) to update its handicap index cards. However, both the GHIN system and the IDC system have a computerized database system for regularly receiving member scores, generating each golfer's handicap index, and forwarding the results to the individual golfer.

Under the GHIN system, the member golf clubs will periodically transmit their members' scores to a central computer, presently located in New Jersey. Usually, such scores will be transmitted about every two weeks (or on a schedule dictated by the USGA) over telephone lines using a modem. Once every month, the GHIN system central computer compiles all of the submitted information and computes updated handicap indexes for each golfer. This information is printed on stickers which are then mailed to the golf clubs for distribution to their members. Once the golfer receives the sticker, it is placed on the card and used as evidence of the golfer's official handicap index.

Upon completion of a round of golf, two general methods are available for recording the golfer's score for submission to the GHIN system. One method is a manual method where the golfer manually writes identification information and the posted score on a posting sheet. The posting sheet is then delivered or mailed to the GHIN headquarters for entry of the scores in the GHIN database.

The second general method is a computerized method where the golfer will input the posted score into a computer that is typically located in or near the clubhouse. Such systems typically employ a conventional personal computer having a keyboard for entering golfer identification information and the posted score. The computer has a database for storing this information. Periodically, the recorded information in the database is transmitted (typically via a modem) to the GHIN system for updating of the handicap indexes as previously described.

One important aspect of the GHIN system is the need for peer review. In an effort to insure that a golfer will enter a correct score, the USGA rules require each computer terminal to provide the ability for the golfer's peers to review the posted score to determine if it was correctly entered. Currently, in most computerized systems, peer review is provided by allowing any golfer to access another golfer's scores by typing in the golfer's name or other identification information to pull up a screen containing the golfer's.

SUMMARY OF THE INVENTION

The invention provides exemplary systems and methods for updating a golf handicap index. According to one exemplary method, a handicap index is updated by providing a card having golfer information relating to a particular golfer. Such golfer information includes posted scores used in the calculation of a current handicap index. A local processing unit is also provided which includes calculation information for calculating an updated handicap index. The golfer information is transferred from the card to the local processing unit, and a score is also entered into the local processing unit for a completed round of golf. The local processing unit is then employed to compute an updated handicap index based at least in part on the entered score. In this way, a golfer is able to obtain an updated handicap index upon completion of a round of golf, rather than waiting for an extended period of time. Of course, under current USGA regulations, the invention may be configured to produce updated handicap indexes according to current rules, i.e. not more frequently than once every two weeks and not less frequent than once a month.

In one particularly preferable aspect, the card is updated with the updated handicap index, if appropriate, and the latest entered score. In the event that USGA rules require that a person's handicap index may only be updated within certain time periods, the local processing unit may be configured to indicate whether the updated information includes the entered score.

One particular advantage of the present invention is that each golf course may be provided with its local processing unit so that a golfer may take the card to numerous other golf courses to have the handicap index updated after a round of golf. Further, in the event that the golfer plays at an away golf course, the local processing unit at the away golf course will preferably be configured to transmit the entered score to the golfer's home course. Preferably, the local processing units will be interconnected by the Internet so that scores and other information may be transferred between the local processing units. Additionally, processing units that are associated with state or local golf associations, or a national golf association (such as the USGA) may also be connected to the Internet so that they may receive updated scores from the local processing units.

In still another aspect of the method, the local processing unit includes a display screen to allow a list of golfer's scores to be scrolled across the display screen. In this manner, a convenient way is provided to allow a golfer's peers to review an entered score simply by watching the scores scroll across the display screen. The scrolled scores may be grouped in a variety of ways, such as, for example, by scrolling the names of each member of the club, by scrolling the scores of the golfers playing that day, or by scrolling the scores of golfers who played their last round of golf with the entering golfer.

In still another aspect, a golfer will be required to enter check-in information into the local processing unit to indicate that a round of golf is to be played. In the event that the golfer fails to enter a score after playing a round of golf, a flag is recorded in the local processing unit. In yet another aspect, the local processing unit is periodically updated with course rating information for a plurality of golf courses. For example, an administrative processing unit may be connected to the Internet to send course rating information to each of the local processing units. In this way, when a golfer plays at an away course which is not part of the system, the golfer may return to his home golf club and enter the appropriate information simply by selecting the course played from a list of courses stored in the local processing unit.

In still yet another aspect, the card includes credit information relating to a credit organization as well as a memory device for storing the golfer information. In this way, the card may be used to store the updated handicap index as well as for making a credit purchase.

The invention further provides an exemplary method for monitoring a golf handicap index system. According to the method, a card is provided having golfer information relating to a particular golfer which includes posted scores used in the calculation of a current handicap index. A local processing unit is also provided having calculation information for calculating an updated handicap index. Prior to playing a round of golf, check-in information is entered into the local processing unit. If a golfer fails to enter a score into the local processing unit following a round of golf, a record of non-entry is produced for review by the handicap committee at the golf club.

Optionally, a score may be produced for the unentered round. Based on the produced score, the local processing unit may then update the handicap index. As one example, the produced score may be the lowest score of the golfer's last 20 scores.

The invention further provides an exemplary golf handicap system which comprises at least one local processing unit having calculation information for calculating an updated handicap index. The system further includes at least one handicap card having golfer information relating to a particular golfer and includes posted scores used in the calculation of a current handicap index. The local processing unit further includes a reader and a writer to allow the golfer information to be read from the card and an updated index to be recorded on the card. Further, an entry device is provided to allow golf scores to be entered into the local processing unit so that updated indexes may be calculated.

Preferably, the handicap card will be a "smart card" type card to allow digital information to be read from the card and recorded onto the card. Optionally, such a card may also include credit information relating to a credit organization. In this way, the handicap card will also function as a conventional credit card. Further, the card may include a region for displaying the current handicap index so that the current index will be visually accessible when needed to prove a golfer's current handicap index.

In one exemplary aspect, a plurality of local processing units are provided which are interconnectable to transfer scores and indexes between selected local processing units. In this way, each golf course may be provided with its own local processing unit to allow updated handicap indexes to be produced in real time at the golf course. Further, each local processing unit will preferably include a list of a plurality of away golf courses. The local processing units will preferably be configured to display such a list to allow a golfer to select one of the courses from the list. In this way, when a golfer returns from an away course, the golfer may scroll through the list of courses and select the away course previously played. The golfer may then enter the score posted at the selected away course. The local processing unit will preferably store course rating information for various away golf courses (such as those used most frequently by members of the club) so that the handicap index may be updated based on the score posted at the away golf course. Optionally, course rating information may be downloaded on demand from a central computer if not stored locally in the local processing unit.

In another aspect of the system, the local processing unit includes a display screen having a region for scrolling scores of golfers. In this way, a mechanism is provided for convenient peer review of posted scores.

In still another aspect, a national processing unit is provided which is interconnectable with the local processing units. The national processing unit includes a database for storing the handicap indexes and posted scores from each of the local processing units. In this way, a mirror database may be provided for each golfer which belongs to the national golf association. Similarly, local or state processing units may be interconnectable with appropriate local processing units so that they may maintain accurate records of their members' scores and indexes. Preferably, an administrative processing unit will also be provided which is interconnectable with the local processing units. The administrative processing unit may be employed to deliver various software updates as well as current course rating information to each of the local processing units. Various advertisements may also be delivered to the local processing units.

In still a further aspect, the local processing unit is configured to produce a check-in display which allows a golfer to check in prior to playing a round of golf. Once a round of golf is completed, the local processing unit will produce a record of non-entry if a score is not entered by the golfer.

In another exemplary system of the invention, at least one local processing unit is provided having calculation information for calculating an updated handicap index and an entry device to allow golf scores to be entered into the local processing unit and updated indexes to be calculated. The local processing unit further includes a display screen having a region for scrolling scores across the display screen for a plurality of golfers. In this way, a way is provided for convenient peer review by automatically displaying posted scores of the golfers.

DETAILED DESCRIPTION OF THE SPECIFIC EMBODIMENTS

Figure 1:
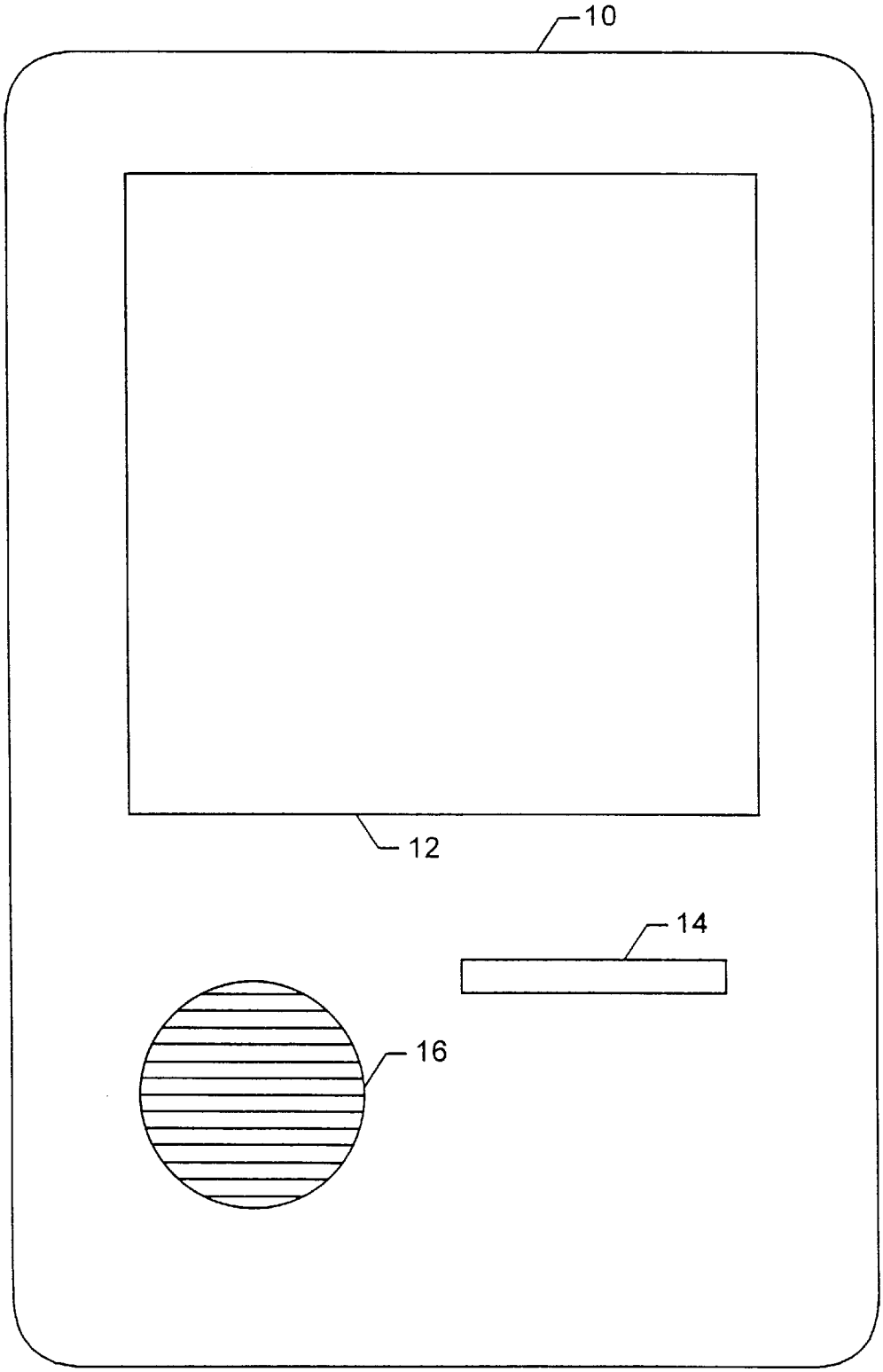
FIG. 1 is a front view of an exemplary local processing unit which would typically be located at a golf club according to the invention.

The invention provides exemplary systems and methods for updating golf handicap indexes. The systems and methods will preferably rely on the use of modern digital technology, including the use of computers, media for storing digital information, and the Internet. Referring now to FIG. 1, an exemplary embodiment of a local processing unit (LPU) 10 will be described. A LPU of the type shown in FIG. 1 will preferably be located in each golf club or other golf association which is a member of a state and a national golf association which are responsible for maintaining golf handicap indexes for their members. LPU 10 is preferably a multimedia-type computer which includes a display screen 12, a media slot 14 for receiving a digital recording medium, and a speaker 16. LPU 10 will preferably be constructed using components used in commercially available home computers and may include, for example, a pentium-type processor and a disk for storing digital information. LPU 10 will preferably also include a modem to allow LPU 10 to interface with the Internet. Appropriate cards, such as video cards, sound cards, and the like are also included to provide various images on display screen 12 as well as sounds over speaker 16.

Stored within LPU 10 is appropriate code which enables LPU 10 to update a golfer's handicap index each time a score is entered. Conveniently, scores (and other relevant information) may be entered into LPU 10 by configuring display screen 12 to be a "touch entry" type screen or providing a conventional keyboard. Such "touch entry" screens are available from a variety of commercial supplies, such as Elo Touch Systems and Trident Technology Solutions.

The code stored within LPU 10 to update the handicap index will preferably be one that is approved by the local and national golf associations. For example, the major golf association within the United States is the USGA, which calculates an updated handicap index as follows. First, a converted differential is calculated which equals the adjusted score minus the course rating multiplied by 113 and divided by the slope. For example, at a golf club where the regular men's tees have a course rating of 70.1 and a slope of 121, and if a score of 80 were shot, the converted differential would equal $(80-70.1)\times(113\div121)=9.2$. The current handicap index is then calculated by averaging the ten lowest converted differentials and multiplying the average by 96%. LPU 10 is configured to calculate handicap indexes upon entry of scores following a round of golf. In this way, a golfer is able to obtain a current handicap index at the time that a round of golf is completed, rather than waiting for the index to be calculated at a single central processing center as is currently the case with the USGA GHIN system. Of course, under current USGA regulations, the invention may be configured to produce updated handicap indexes according to current rules, i.e. not more frequently than once every two weeks and not less frequent than once a month, or according to USGA handicap system guidelines as they evolve.

LPU 10 is able to calculate and record the updated handicap index at the time the scores are entered or, alternatively, according to current USGA handicap system guidelines. One particular advantage of LPU 10 is that it may provide an indicator to let the golfer know if his handicap index includes recently posted scores in the event that the index may be only be updated periodically according to current USGA rules.

Figure 2A:
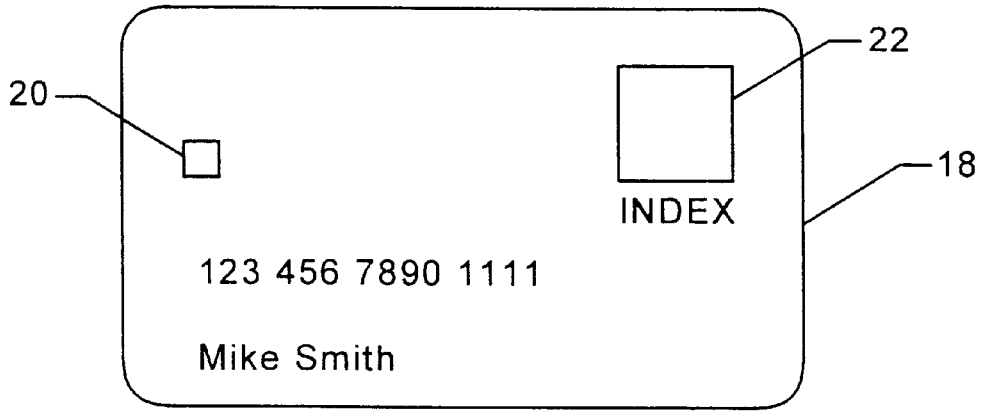
FIG. 2A is a front view of an exemplary handicap index card which may be inserted into the local processing unit of FIG. 1 to provide the local processing unit with information relating to the golfer's handicap index according to the invention.
Figure 2B:
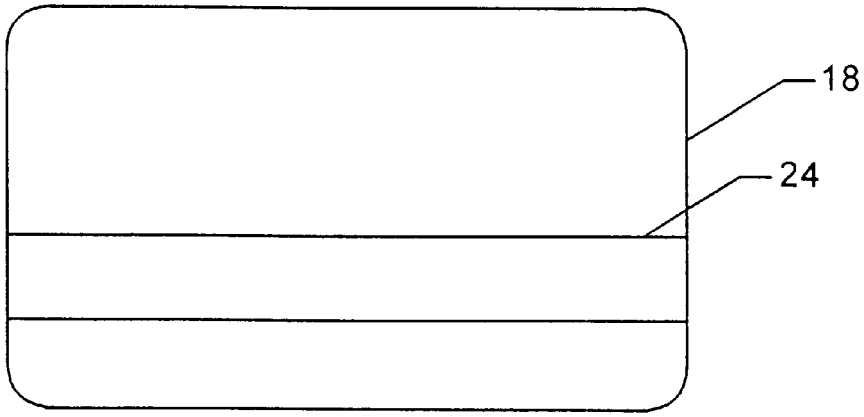
FIG. 2B is a rear view of the handicap index card of FIG. 2A showing a magnetic stripe having credit information to allow the handicap index card to also function as a credit card.

Referring now to FIGS. 2A and 2B, a preferable type of handicap index card 18 for use with LPU 10 will be described. Index card 18 is preferably a "smart-card" having a microprocessor 20 which allows digital information to be both recorded on and read from card 18. Such smart-cards are described in U.S. Pat. Nos. 4,874,935 and 5,293,424, the complete disclosures of which are herein incorporated by reference.

Handicap index card 18 will preferably be employed to store personal information about the golfer, his golf club to which he is a member and golf handicap information. For example, card 18 may include the golfer's name, address and golf membership association information. Card 18 preferably also stores a number of the golfer's latest posted scores such as the last 20 posted scores), as well as the rating and differential information associated with each score. Finally, a current handicap index will preferably be stored on card 18. In this way, when card 18 is inserted into media slot 14, LPU 10 will be able to read the appropriate information from card 18 so that an updated index may be calculated simply by having the golfer enter into LPU 10 information relating to the last round of golf played. To read and write information on card 18, LPU 10 will preferably include a smart card and/or magnetic stripe reader, commercially available from Mag-Tek Inc.

Although described as a smart-card, a variety of digital media may be employed to record the golfer information in digital form. For example, card 18 could comprise a magnetic card, an optical card, a memory only card, other computer microprocessor cards, and the like. Appropriate reading and writing devices for such cards would also be incorporated into LPU 10 as its know in the art.

As illustrated in FIG. 2A, card 18 may include a index window 22 for conveniently displaying the golfer's current handicap index. A variety of schemes may be employed to display current handicap index, including LED screens, pocket-sized card readers, thermo chromic foils which are re-writable and available from Ricoh and Panasonic, and the like. Use of such an index window is advantageous in that a sticker having the current index is not required to be placed on the card monthly as is presently the case with the USGA GHIN system. Rather, the current index may be conveniently displayed through window 22.

Another feature of handicap index card 18 is that it may be incorporated into a conventional credit card having a magnetic stripe 24 as illustrated in FIG. 2B. Magnetic stripe 24 stores credit organization information so that card 18 may conveniently be used as a credit card, as well as a handicap index card. Such credit cards are widely known and available from commercial suppliers, such as VISA, Mastercard, American Express, and the like. As the infrastructure at the merchant level is configured to accept smart cards rather than mag stripe cards, the credit information will preferably cohabitate on the chip with the golf handicap information. Additionally, the microprocessor on the smart card may also be configured to store and operate various other applications, including medical history and allergies, eye glass prescriptions, phone card information, drivers licenses, stored values, and the like.

Figure 3:
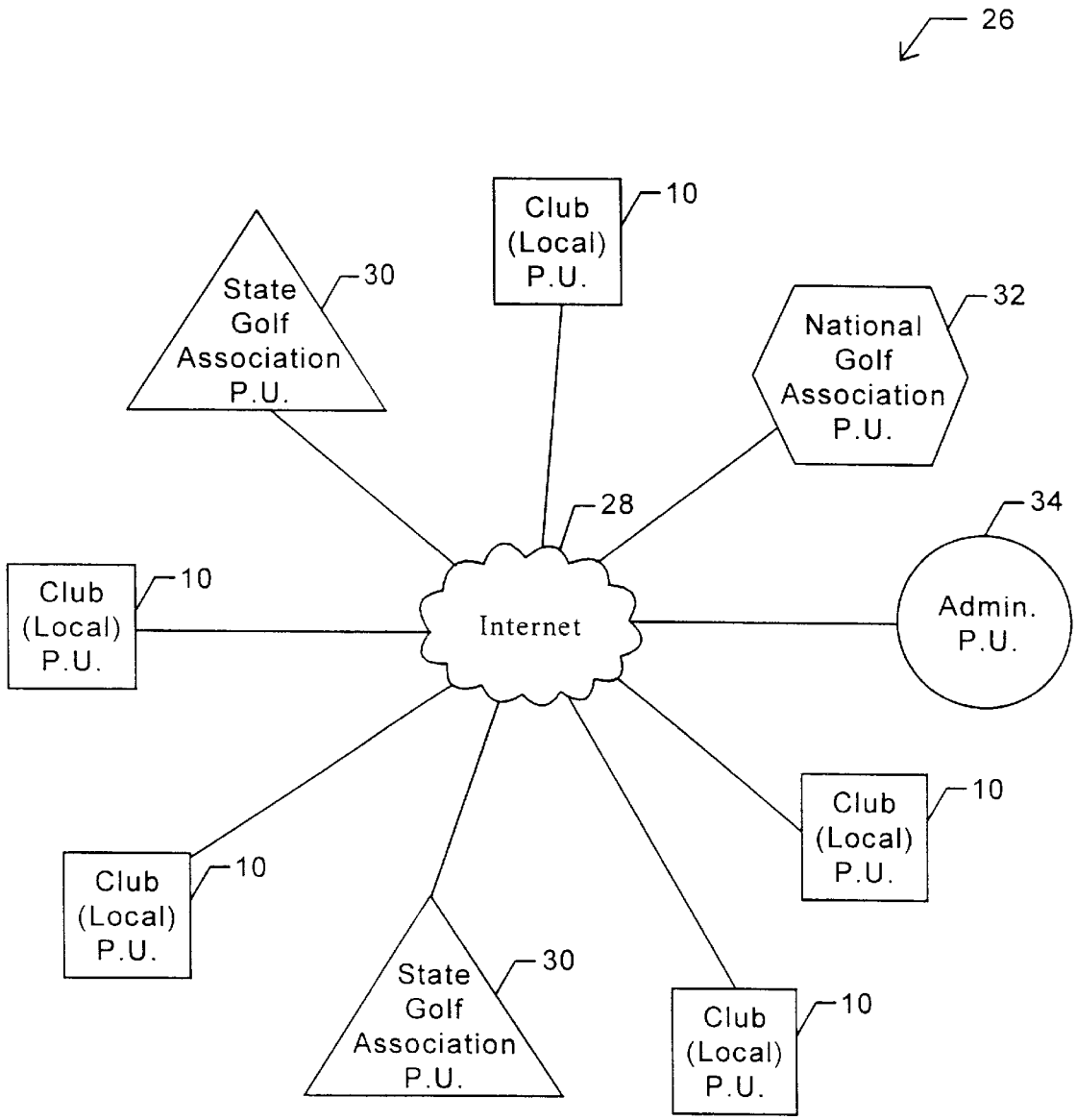
FIG. 3 is a schematic view of an exemplary golf handicap system according to the invention.
Figure 4:
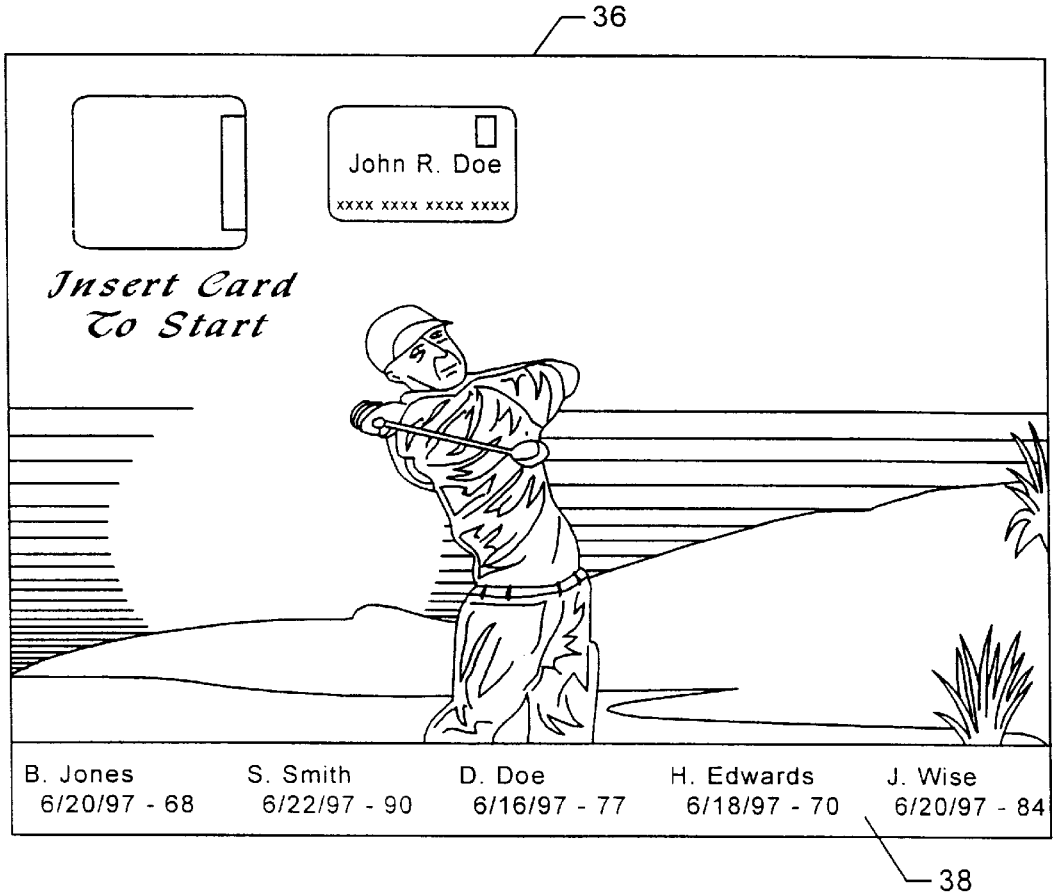
FIG. 4 illustrates a home window of a display screen of the local processing unit of FIG. 1 according to the invention.
Figure 5:
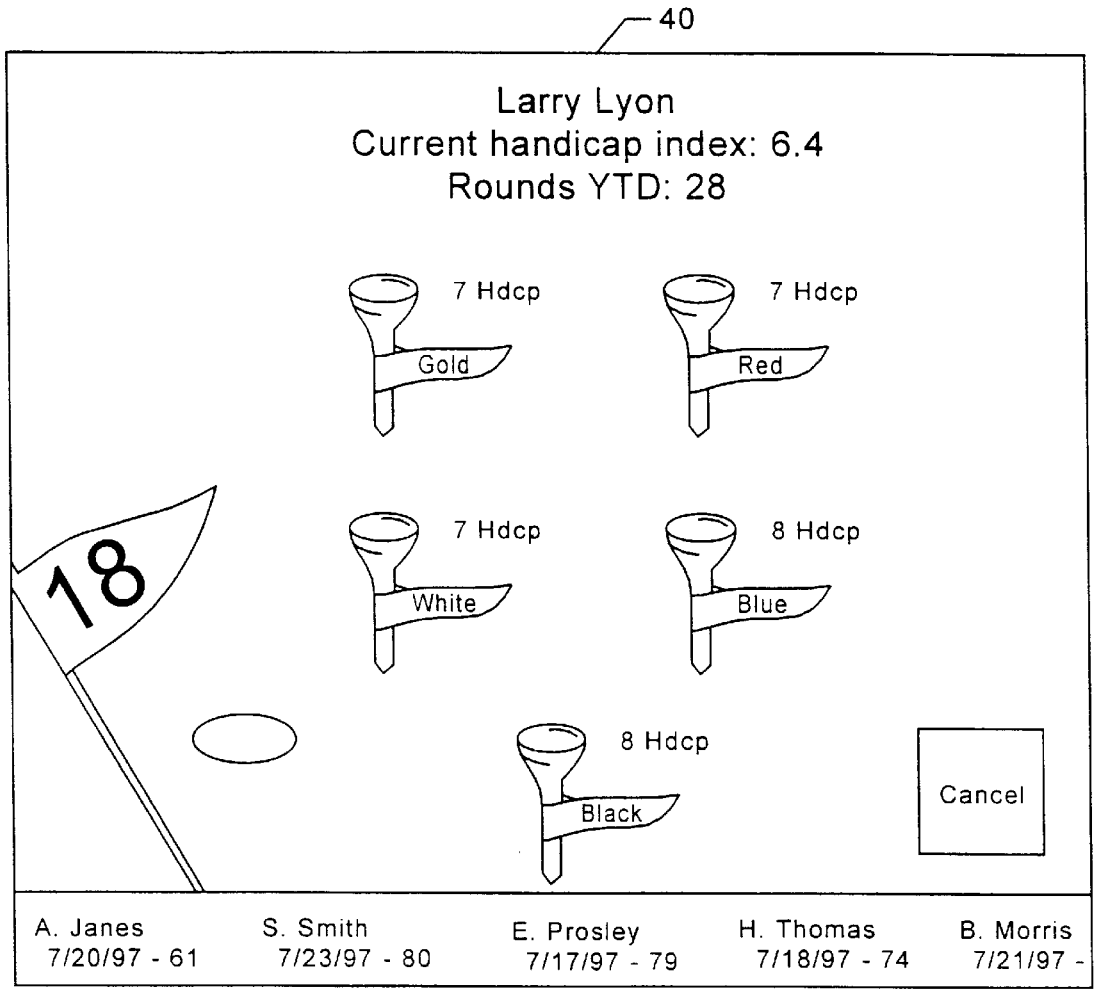
FIG. 5 illustrates a handicap index window of the local processing unit of FIG. 1.

Referring now to FIG. 3, an exemplary golf handicap index system 26 will be described. System 26 includes a plurality of club or local processing units which are essentially identical to LPU 10 and will be referred to with the same reference numeral. As previously described, each LPU 10 will be located at a golf country club or other golf association so that current handicap indexes may be calculated directly at the golf club, rather than a central processing unit associated with a national golf association. Conveniently, each LPU 10 may be placed in communication with any other LPU 10 via the Internet 28 or other telecommunications network. In this way, if a golfer posts a score at an away golf course, the LPU 10 for the away golf course may send the posted score to the golfer's home LPU 10 b simply connecting to Internet 28 and transmitting the information as is known in the art. Also interconnectable with each LPU 10 via Internet 28 are state golf association processing units 30, a national golf association processing unit 32, and an administrative processing unit 34. Each state golf association processing unit 30 will be associated with a state golf association to which each country club or local golf association for a particular state will typically be associated. In this way, each LPU 10 within a given state may periodically transmit updated handicap information to the state golf association processing unit 30, which will contain an updated database for all of its members. In this way, the state golf association may monitor handicap information, as well as serving as a backup database for the handicap information. Conveniently, each LPU 10 will store handicap index information for each golfer belonging to the golf club, thereby providing backup records for the golfer's scores.

National golf association processing unit 32 will also have a database for storing handicap index information from each LPU 10 so that it may also have an updated database with the handicap information. Administrative processing unit 34 will be used to periodically update and service each of LPUs 10. For example, each LPU 10 will include a database having slope and rating information for various golf clubs across the nation. This allows updated handicap indexes to be calculated at a particular LPU 10 regardless of where the golfer played the round of golf as previously described. In the event that any of the golf courses updates its slope or rating information, administrative processing unit 34 will be employed to update each database within LPU 10 so that they will have current course rating and slope information. Other software updates necessary to run LPUs 10 may also be sent to each LPU 10 from administrative processing unit 34 via Internet 28. Preferably, information transmitted between LPUs 10, state golf association processing units 30, national golf association processing unit 32 and administrative processing unit 34 will be encrypted to insure security.

Administrative processing unit 34 may also be employed to transmit advertising information to selective LPUs 10. In this way, businesses or other organizations may present their advertising at selective LPUs 10 from a central location.

Referring now to FIGS. 4–15, an exemplary method for updating a golfer's handicap index using LPU 10 (see FIG. 1) will be described. The windows illustrated in 4–15 will be those which may be displayed on the display screen 12 of LPU 10. In its normal mode of operation, display screen 12 will display a home window 36 (see FIG. 4) which instructs the golfer to insert his golf handicap index card (such as card 18) to start the updating procedure. Conveniently, various advertising information may be provided within window 36 so that advertisers will have the opportunity of marketing their products or services from display screen 12 as previously described.

Importantly, home window 36 includes a display region 38 which displays names of various golfers and their recently posted scores. The purpose of display region 38 is to provide a peer review system so that a golfer's peers may conveniently (and non-intrusively) view the posted scores of golfers to insure both that scores have been entered after a round of golf and that the entered scores are correct. Preferably, the golfer's names and posted scores will be scrolled across display region 38 so that club members may conveniently and efficiently view the posted scores.

The names and scores scrolled across display region 38 may be grouped into certain categories in order to facilitate convenient and easy viewing by relevant golfers. Typically, for home window 36, the name of each golfer who is a member of the club and their most recently posted score will be scrolled across display region 38. However, smaller groups of golfer's name may be scrolled across display region 38 for quicker viewing. As described in greater detail hereinafter, certain windows may be employed to display only the group of golfers which played their last round of golf with the golfer presently entering a score. In this way, the golfer entering the information can quickly scan to see if the golfers with whom he played a previous round entered correct scores.

Upon insertion of handicap index card 18 into media slot 14, handicap index display window 40 is produced. Window 40 displays the golfer's name, current handicap index and the number of rounds year to date. In this way, a golfer can quickly verify his current handicap index by inserting his card into LPU 10 to display the current information. As shown, golfer names and scorers are scrolled across the window to provide for peer review.

Once the golfer has entered his card into LPU 10, the names of golfers scrolled across the display screen will preferably change to the group of golfers for which the entering golfer previously played a round of golf. In this way, the golfer may more conveniently review the posted scores of his fellow golfers.

Figure 6:
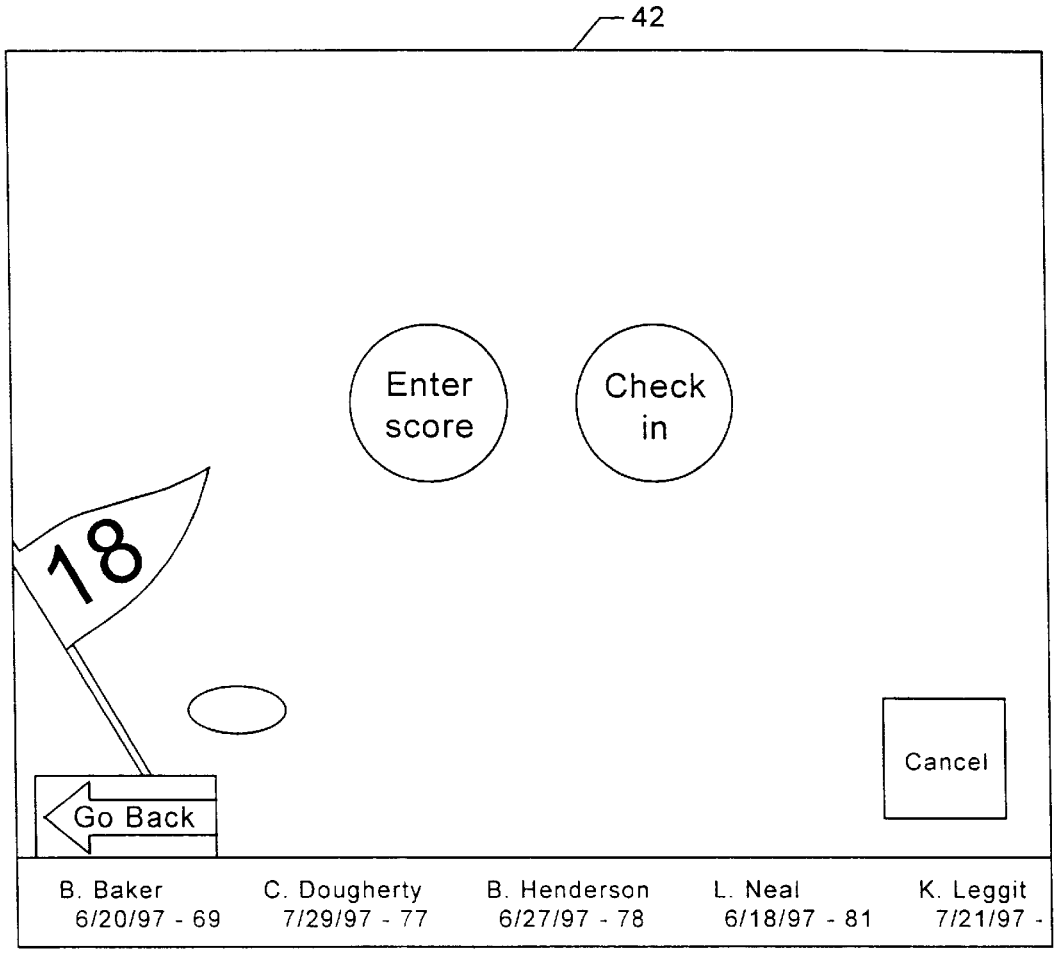
FIG. 6 is a check-in/entry window of the local processing unit of FIG. 1.

As illustrated in FIG. 6, a check-in/entry window 42 is next displayed. If the check-in region is touched, LPU 10 notes that the golfer has checked in for the round of golf. Preferably, the golf club will have access to this information and will not allow a golfer play until checking in this manner. Following a round of golf, if the golfer fails to enter a score into LPU 10, LPU 10 will store a record of the non-entry. In this way, appropriate action may be taken against the negligent golfer. Alternatively, LPU 10 may be employed to calculate a "default" score for the non-entered score. Such a default score may comprise, for example, an average of the golfer's last 10 lowest scores. The golfer's handicap index may then updated with this score.

Figure 7:
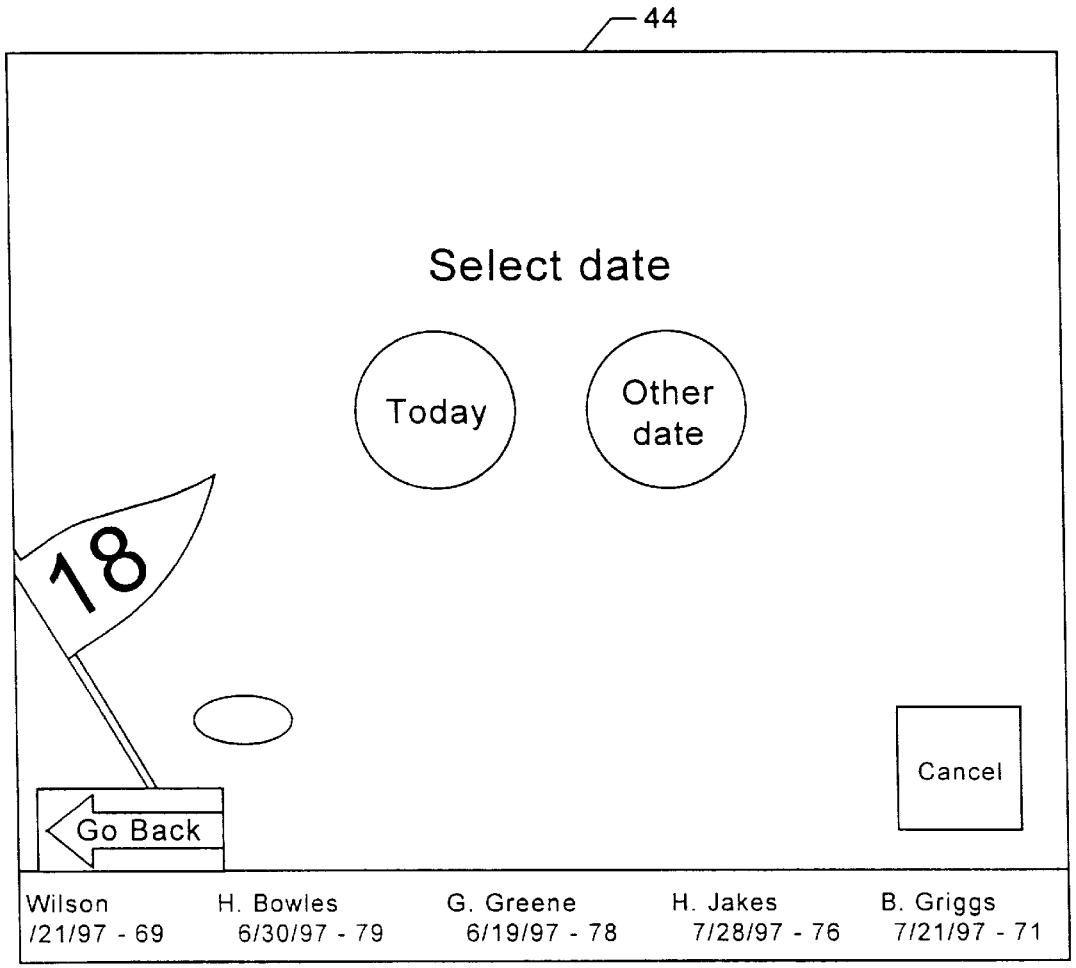
FIG. 7 is a date entry window of the local processing unit of FIG. 1.
Figure 8:
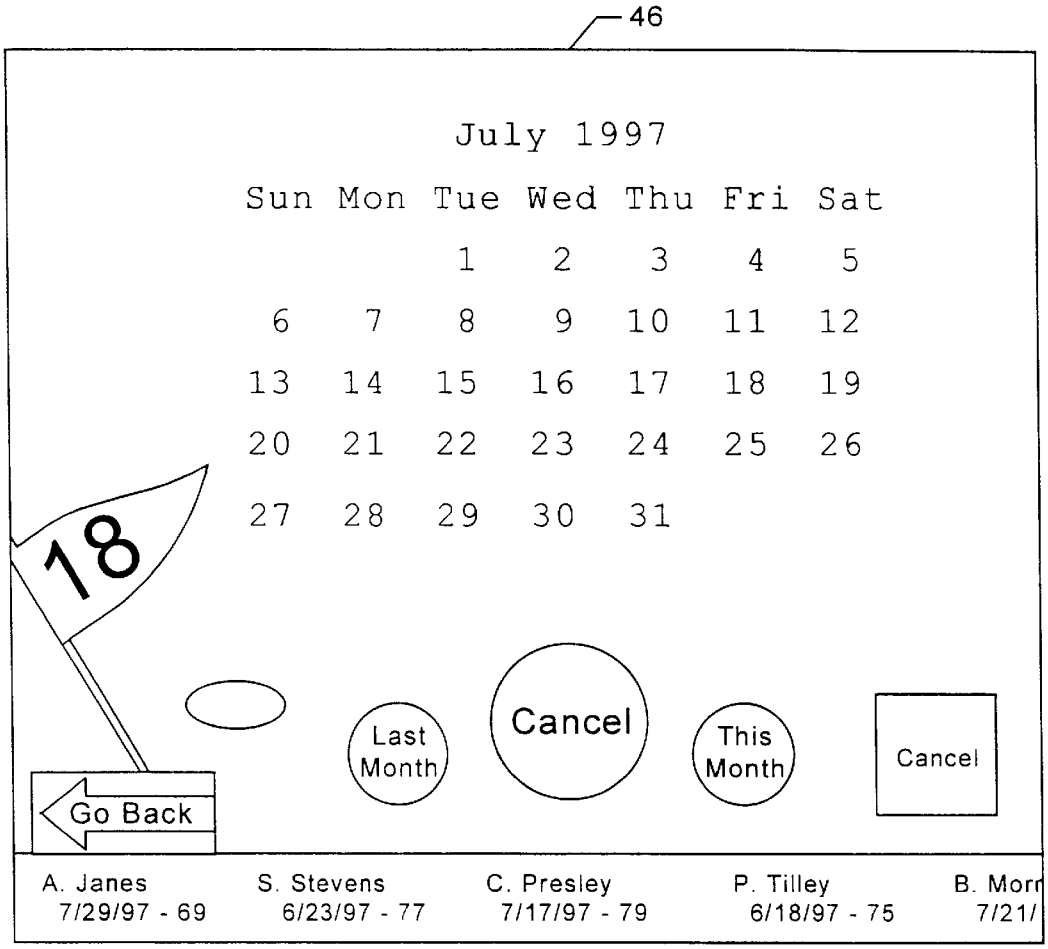
FIG. 8 is a calendar window which allows for the selection of a date to be entered.

To enter a score following a round of golf, the golfer selects the enter score region of window 42 which will cause date selection window 44 to be displayed as illustrated in FIG. 7. From window 44, the golfer is able to select whether the round of golf was played on today's date or a previous date. If the "other date" region is selected, a calendar display window 46 will be produced as illustrated in FIG. 8. From window 46, the golfer may select the date for which he wishes to enter the score.

Figure 9:
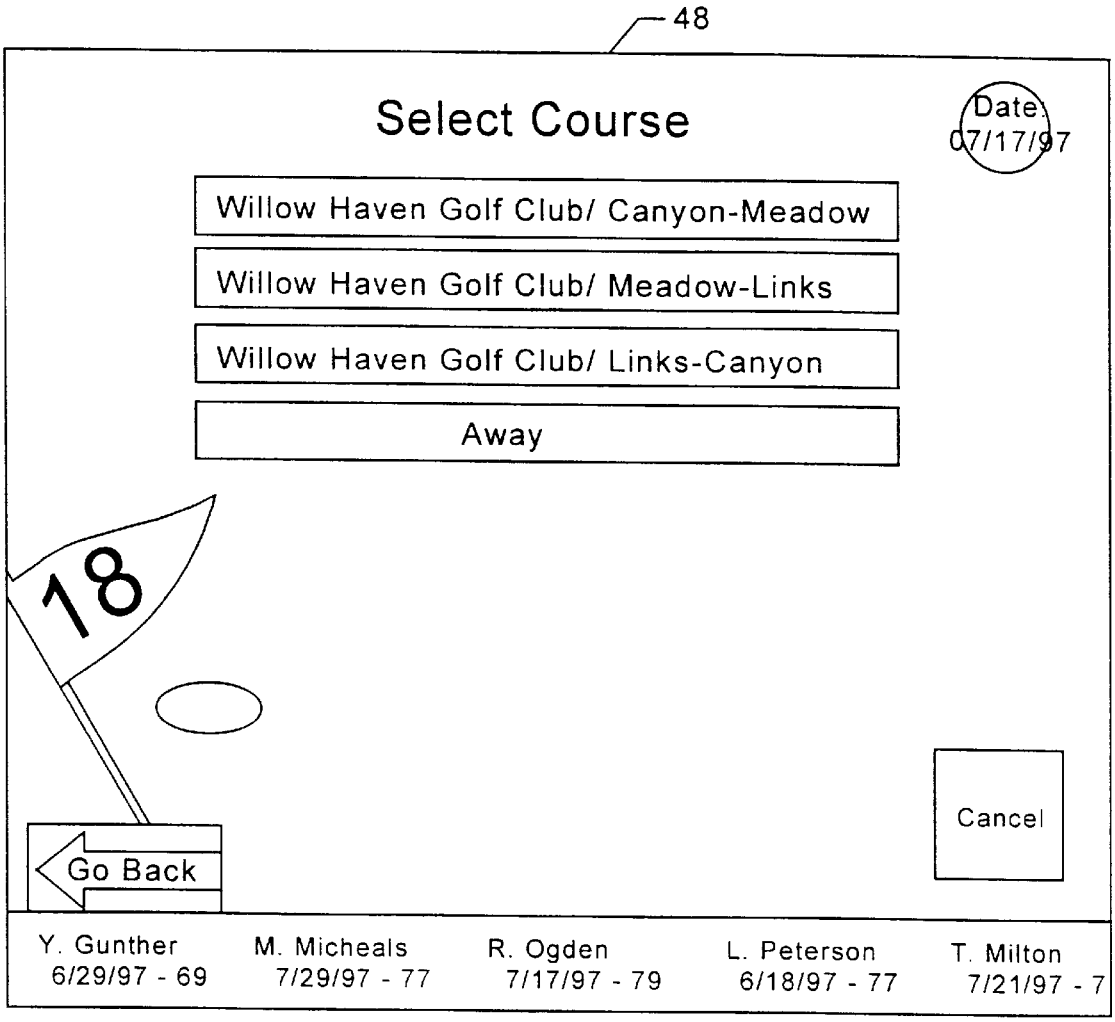
FIG. 9 is a golf course selection window of the local processing unit of FIG. 1.
Figure 10:
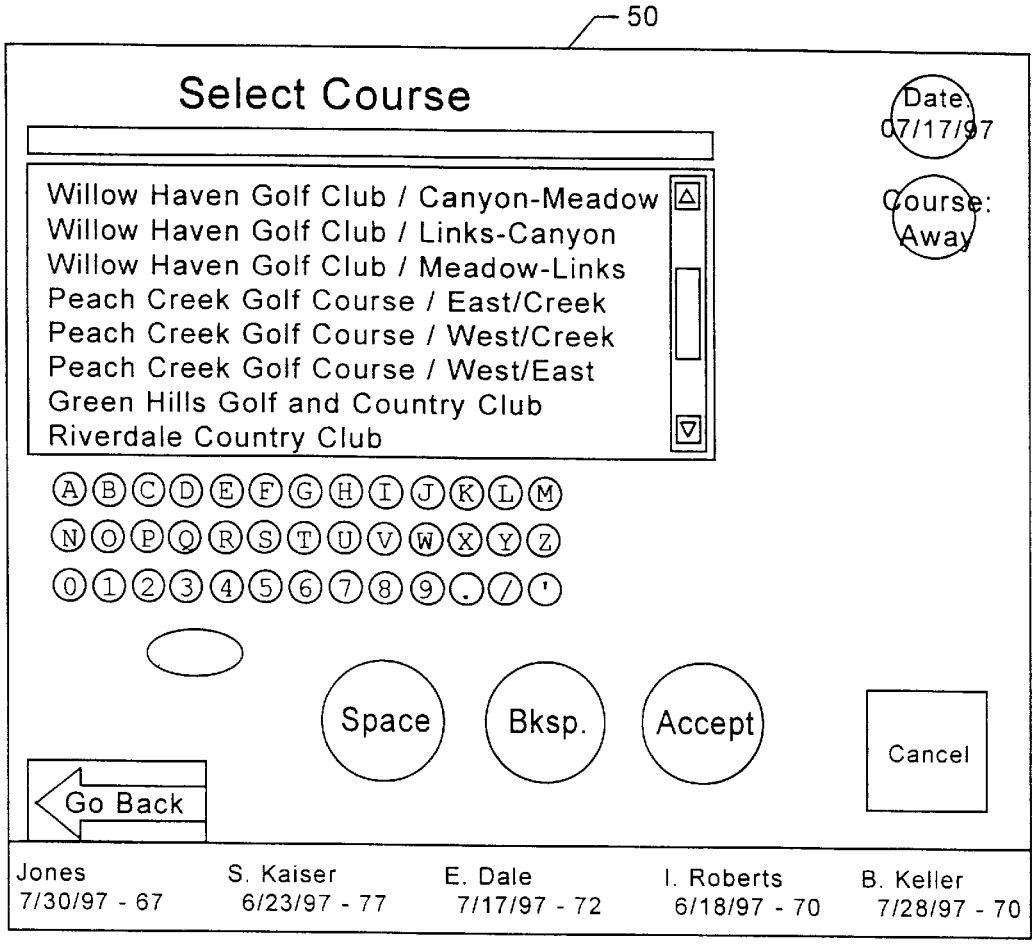
FIG. 10 is an away course selection window of the local processing unit of FIG. 1.

As illustrated in FIG. 9, a course selection window 48 allows the golfer to select whether the score being entered is for the golfer's home course or an away course. As shown, the golfer's club includes three courses from which to select. If the course is an away course, the golfer selects the away region to produce an away golf course selection window 50, as shown in FIG. 10. Optionally, a window with a map of the country may be displayed to allow the golfer to select a desired state where the round of golf was played. The golfer is then able to scroll through a list of golf courses as shown. Preferably, the list will include various golf courses within the United States, and in some cases may even include golf courses throughout the world. When the appropriate away course has been found, it may be selected by touching the accept region. As previously described, LPU 10 includes slope and rating information for each golf course so that the golfer is not required to enter this information in order for a current handicap index to be calculated.

Figure 11:
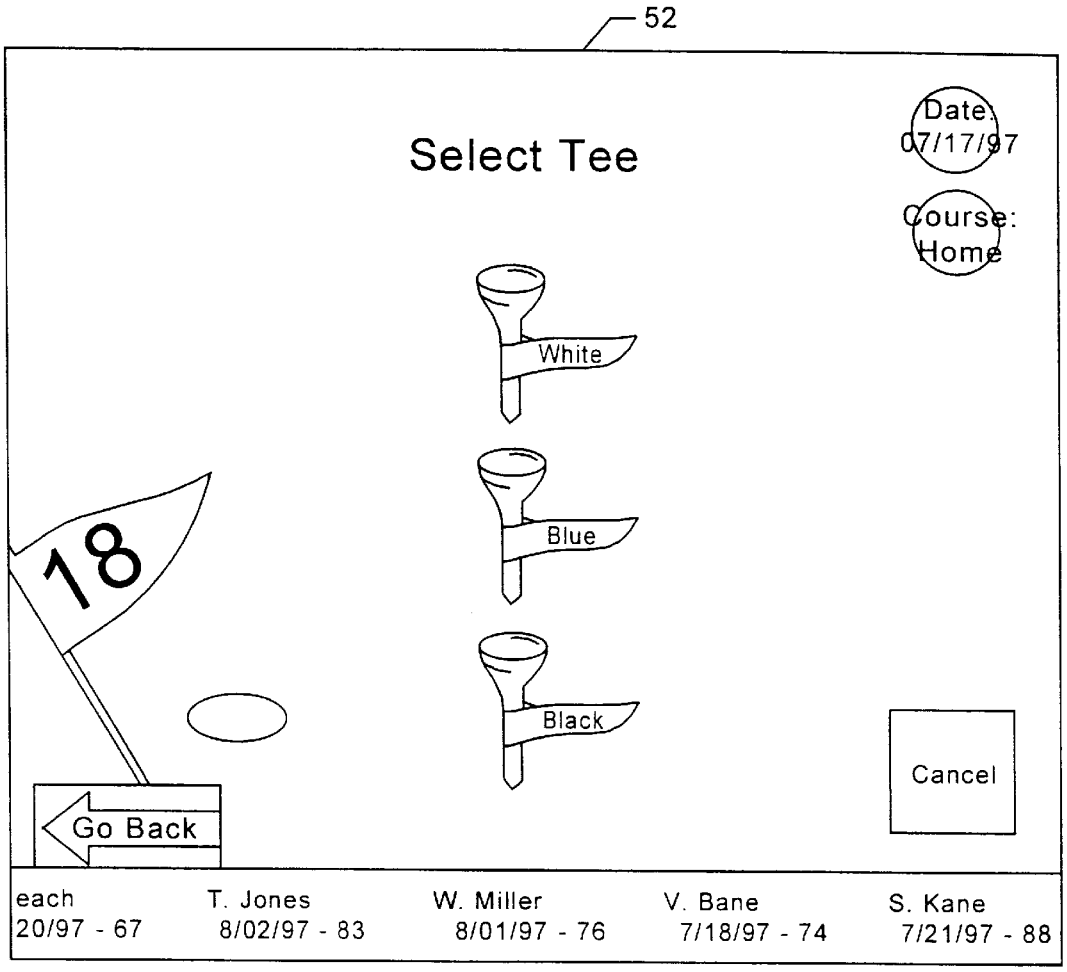
FIG. 11 is a tee selection window of the local processing unit of FIG. 1.
Figure 12:
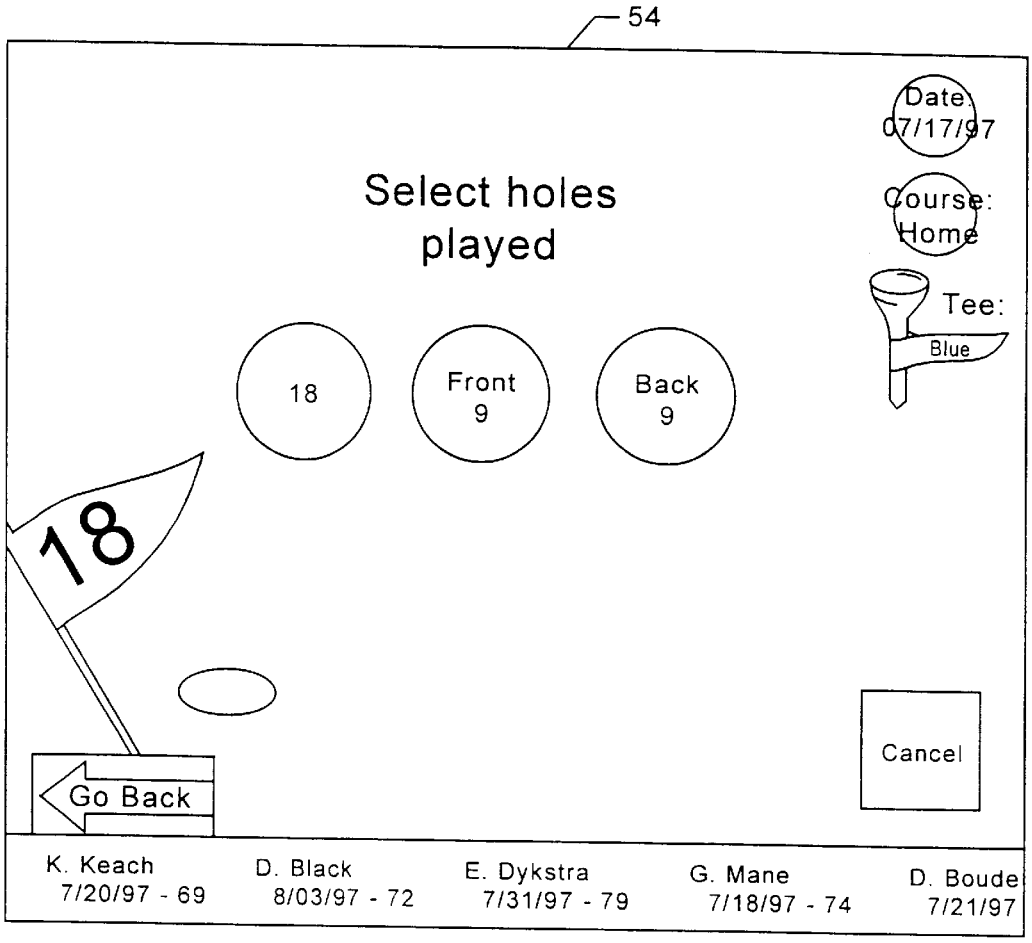
FIG. 12 is a hole selection window of the local processing unit of FIG. 1.

Following selection of the appropriate course, a tee selection window 52 is displayed as illustrated in FIG. 11. Touching the appropriate tee, the golfer is able to select which tees were played from for the appropriate round of golf. The golfer is then able to select which holes were played as illustrated in hole selection screen 54 of FIG. 12. For example, the golfer may select whether all 18 holes were played or whether only the front or back 9 were played.

Figure 13:
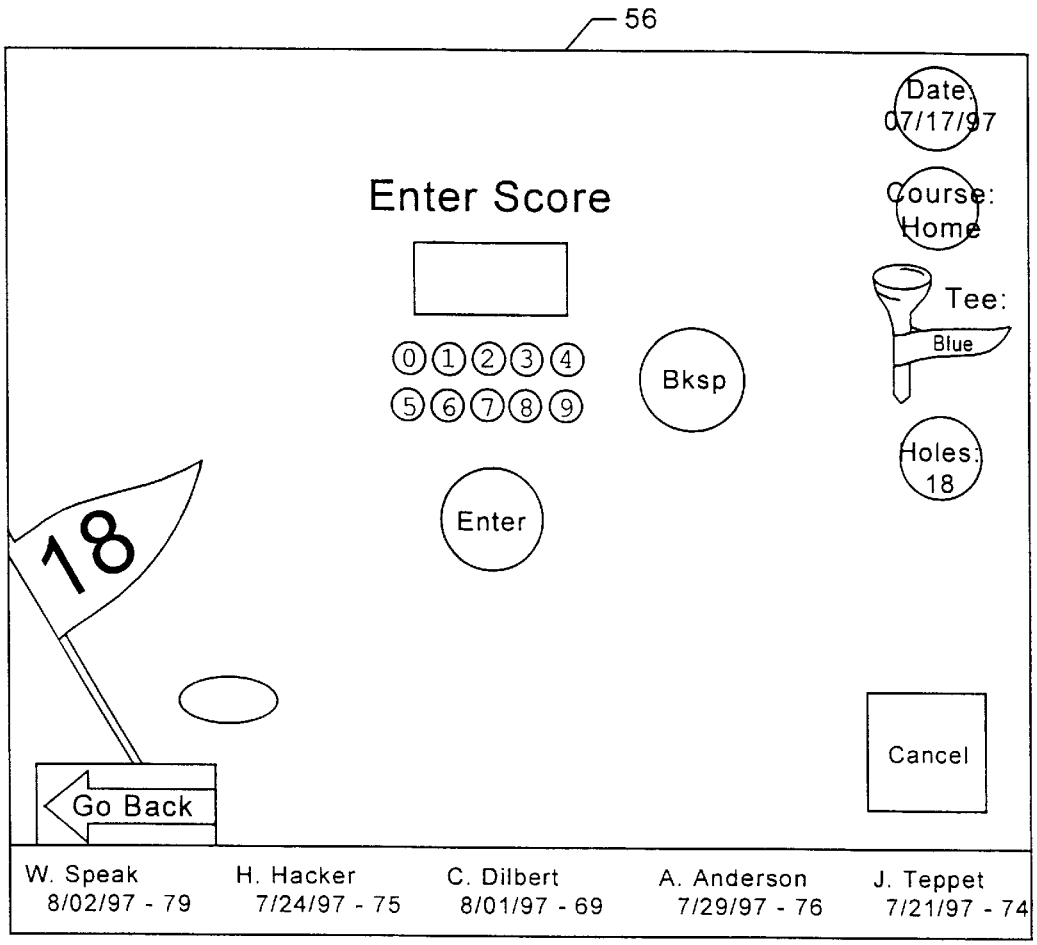
FIG. 13 is a score entry window of the local processing unit of FIG. 1.
Figure 14:
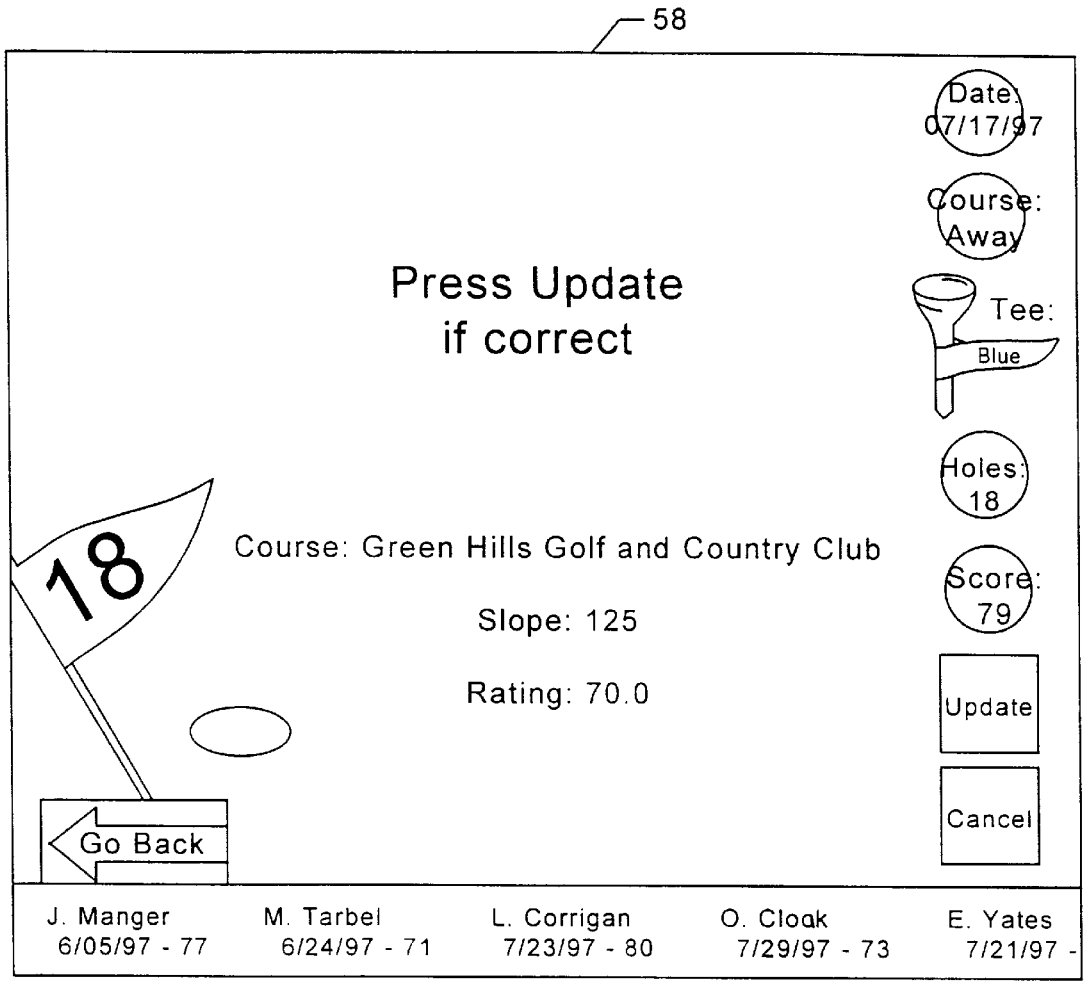
FIG. 14 is a confirmation selection window of the local processing unit of FIG. 1.

As illustrated in a score entry window 56 of FIG. 13, the golfer is then able to enter the score for the round of golf. Conveniently, the score may be entered by touching the appropriate numbers on the display screen and then selecting the enter region. Following entry of the score, an update window 58 is displayed as illustrated in FIG. 14. Update window 58 summarizes the entered information, including the selected course, its slope and rating. If all the information is correct, the golfer selects the update region to certify the information is correct. Otherwise, the golfer may cancel the information and go back to previous screens to insure that the entered information is correct.

Figure 15:
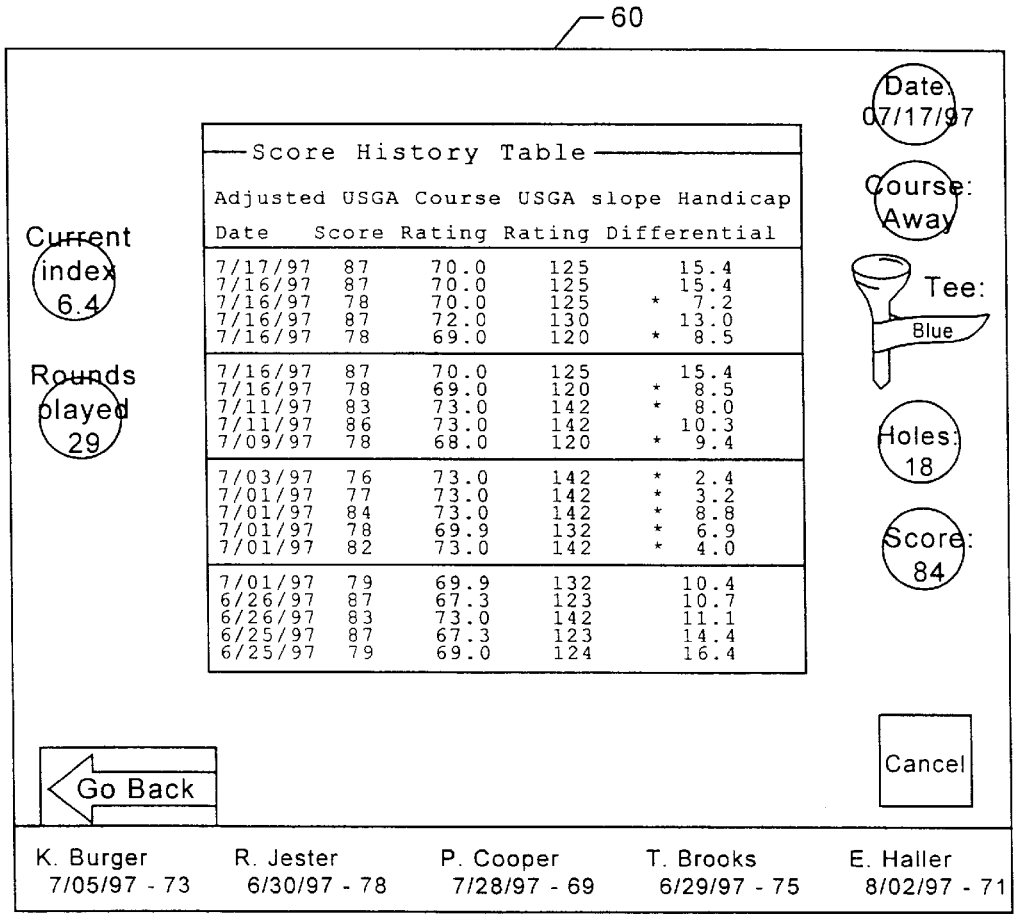
FIG. 15 is a score history window of the local processing unit of FIG. 1.

As illustrated in FIG. 15, the score history window 60 is displayed to illustrate the golfer's last 20 scores, the date of which the scores were posted, the adjusted score, slope and rating information, and the handicap differential. Conveniently, an asterisk is placed by the lowest 10 scores. One advantage of the invention is that such information is stored on the golfer's handicap index card so that when the card is inserted into LPU 10, the information will be loaded into LPU 10. In this way, LPU 10 may calculate an updated handicap index and store the updated information (including the recently entered score) directly on the handicap index card. Hence, the golfer may the take his card to any course having an LPU and receive an updated index after a round of golf.

Window 60 also displays the golfer's current index and the number of rounds played. Although not shown, window 60 may also be able to provide information indicating whether the current index includes recently posted scores. Such, may be the case if, according to USGA rules, the current index may only be updated once every two weeks. Both the entered and updated information is stored both on LPU 10 and written on handicap index card 18. In this way, a duplicate record of the golfer's information will be available. Further, by storing the data directly on the handicap index card, the golfer may use this card at any golf course and conveniently have his index updated following a round of golf.

Periodically, such as at the end of each day, the information entered into LPU 10 will be sent over the Internet to state and national golf associations so that duplicate records may be maintained for the associations as well. In the event that the golfer has played at an away course, the information will be sent via the Internet to the golfer's home course.

As previously described, another advantage of providing index card 18 is that it may be used to confirm the golfer's current index. The index may be displayed directly on the card or by inserting the card into LPU 10 at the golf club or in monitors which may be placed at selected tees on the golf course.

Microprocessor 20 will preferably include security information which will allow information to be stored on card 18 only when using one of the local processing units. In this way, scores may not be tampered with by entering card 18 into a non-authorized computer.

Although the foregoing invention has been described in detail for purpose of clarity of understanding, it will be obvious that certain modifications may be practiced within the scope of the appended claims.

What is claimed is:

1. A method for processing golf information, comprising:

providing a card having golfer information relating to a particular golfer including posted scores used in the calculation of a current handicap index;

providing a local processing unit having calculation information for calculating an updated handicap index, wherein the calculation information includes slope and course rating information for a plurality of golf courses, including golf courses remotely located from the local processing unit;

transferring the golfer information from the card to the local processing unit;

entering a score for a completed round of golf into the local processing unit along with an indication of a golf course where the score was obtained; and computing with the local processing unit an updated handicap index based at least in part on the entered score and the slope and course rating associated with the golf course.

2. A method as in claim 1, further comprising updating the card with the updated handicap index by printing the updated handicap index on the card.

3. A method as in claim 2, further comprising updating the card with the entered score.

4. A method as in claim 1, further comprising indicating whether the updated index includes the entered score.

5. A method as in claim 1, further comprising electronically transferring the entered score to another processing unit over a computer network.

6. A method as in claim 5, wherein the other processing unit is a national processing unit which receives updates from a plurality of local processing units.

7. A method as in claim 5, wherein the other processing unit is another local processing unit at the golfer's local golf club.

8. A method as in claim 5, wherein the entered score is transferred to the other processing unit over the Internet.

9. A method as in claim 1, wherein the local processing unit includes a display screen, and further comprising scrolling a list of golfers scores across the display screen.

10. A method as in claim 9, wherein the golfers scores being scrolled are for golfers playing that day.

11. A method as in claim 1, further comprising entering check-in information into the local processing unit indicating a round of golf is to be played.

12. A method as in claim 11, further comprising producing a flag if a score is not entered subsequent to the entry of the check-in information.

13. A method as in claim 1, further comprising periodically updating the local processing unit with course rating information for said plurality of golf courses.

14. A method as in claim 13, wherein the local processing unit is updated from an administrative processing unit.

15. A method as in claim 1, wherein the card includes credit information relating to a credit organization and includes a memory device for storing the golfer information, and further comprising making a credit purchase with the card.

16. A method as in claim 1, further comprising selecting from the local processing unit whether the course played is a home or an away course.

17. A method as in claim 16, further comprising selecting the away course from a list of courses stored in the local processing unit if the course played is an away course.

18. A method for processing golf information, the method comprising:

providing a card having golfer information relating to a particular golfer including posted scores used in the calculation of a current handicap index;

providing a local processing unit having calculation information for calculating an updated handicap index;

transferring the golfer information from the card to the local processing unit;

entering a score for a completed round of golf into the local processing unit;

computing with the local processing unit an updated handicap index based at least in part on the entered score; and automatically displaying a previously posted score for at least one other golfer on a display screen of the local processing unit, wherein the previously posted score is for a golfer who played a last round of golf with the golfer presently entering the score.

19. A method as in claim 18, wherein the displaying step comprises scrolling the golf score across the display screen.

20. A method as in claim 18, wherein the local processing unit is associated with a golf club having a plurality of members, and further comprising displaying at least some of the member's previously posted scores.

21. A method as in claim 20, further comprising displaying the current handicap index for at least some of the members of the club.

22. A method as in claim 18, further comprising selecting an entry screen to enter the score, and further comprising displaying posted scores for a group of players who played a last round with the entering golfer upon selection of the entry screen.

23. A method for monitoring a golf handicap index system, comprising:

providing a card having golfer information relating to a particular golfer including posted scores used in the calculation of a current handicap index;

providing a local processing unit having calculation information for calculating an updated handicap index;

entering check-in information into the local processing unit prior to playing a round of golf; and producing a record of non-entry if the golfer fails to enter a score into the local processing unit after playing the round of golf; and producing with the local processing unit a score for the unentered round and computing with the local processing unit an updated handicap index based at least in part on the produced score.

24. A method as in claim 23, wherein the produced score comprises the lowest score of the golfer's last twenty scores.

25. A golf handicap apparatus, comprising:

at least one local processing unit that is associated with a home golf course, the processing unit having a display screen, calculation information for calculating an updated handicap index, a database having a list of plurality of away golf courses, and code to display the list of away golf courses on the display screen, wherein the database further includes slope and course rating information for the home golf course and the away golf courses;

at least one handicap card having golfer information relating to a particular golfer including posted scores used in the calculation of a current handicap index;

wherein the local processing unit includes a reader and a writer to allow the golfer information to be read from the card and an updated index to be recorded on the card, and wherein the local processing unit further includes an entry device to allow golf scores to be entered into the local processing unit and to indicate if an entered score is for the home golf course or one of the away golf courses, and wherein the local processing unit includes code to calculate an updated index based on the entered score and the slope and course rating for the golf course where the entered score was obtained.

26. An apparatus as in claim 25, further comprising a plurality of local processing units which are interconnectable to transfer scores and indexes between selective local processing units.

27. An apparatus as in claim 26, further comprising a national processing unit which is interconnectable with the local processing units, the national processing unit having a database for storing the handicap indexes and posted scores from each of the local processing units.

28. An apparatus as in claim 26, further comprising a plurality of state processing units which are interconnectable with at least some of the local processing units, the state processing units each having a database for storing the handicap indexes and posted scores from at least some of the local processing units.

29. An apparatus as in claim 26, further comprising an administrative processing unit which is interconnectable with the local processing units, the administrative processing unit having a database with current course rating information which may be transmitted to each of the local processing units.

30. An apparatus as in claim 25, wherein each local processing unit includes said list of a plurality of away golf courses and are configured to display the list of golf courses to allow a golfer to select one of the courses from the list.

31. An apparatus as in claim 27, wherein each local processing unit includes a database which stores course rating information for the plurality of golf courses.

32. An apparatus as in claim 25, wherein the display screen includes a region for scrolling scores of golfers.

33. An apparatus as in claim 25, wherein the handicap card comprises a credit card having information relating to a credit organization and a memory device for storing the golfer information.

34. An apparatus as in claim 33, wherein handicap card further includes a microprocessor.

35. An apparatus as in claim 25, wherein the golfer information includes a list of previously posted scores, and wherein the writer is configured to update the card with a score entered into the local processing unit.

36. An apparatus as in claim 25, wherein the local processing unit is configured to produce a display indicating whether the updated index includes the entered score.

37. An apparatus as in claim 25, wherein the local processing unit is configured to produce a check-in display to allow a golfer to enter check-in information into the local processing unit indicating a round of golf is to be played.

38. A apparatus as in claim 37, wherein the local processing unit is configured to produce a record of non-entry if a score is not entered subsequent to the entry of the check-in information.

39. A golf handicap apparatus, comprising:

a plurality of local processing units which are interconnectable with each other, wherein each local processing unit includes calculation information for calculating an updated handicap index; and at least one handicap card having golfer information relating to a particular golfer including posted scores used in the calculation of a current handicap index;

wherein each local processing unit includes a reader and a writer to allow the golfer information to be read from the card and an updated index to be recorded on the card, wherein each local processing unit further includes an entry device to allow golf scores to be entered into the local processing units and updated indexes to be calculated at the local processing units, wherein each local processing unit is associated with a golf course, and wherein each local processing unit has a database that includes slope and course rating information for all of the other local processing units.

40. An apparatus as in claim 39, wherein the local processing units are interconnectable through the Internet.

41. An apparatus as in claim 39, further comprising a national processing unit which is interconnectable with the local processing units, the central processing unit having a database for storing handicap indexes transferred from each of the local processing units.

42. A golf handicap apparatus, comprising:

at least one handicap card having stored thereon golfer information relating to a particular golfer including posted scores used in the calculation of a current handicap index, and a rewritable medium to permit the current handicap index to be written on the medium in a rewritable format to permit visual display of the current handicap index;

at least one local processing unit having calculation information for calculating an updated handicap index and an entry device to allow golf scores to be entered into the local processing unit and updated indexes to be calculated;

a reader coupled to the local processing unit to read the golfer information from the handicap card; and a writing device coupled to the local processing unit to write the updated handicap index on the rewritable medium of the card in a rewritable format such that when a new handicap index is calculated, the new handicap index may be written on the rewritable medium in place of the previous handicap index.

43. An apparatus as in claim 42, wherein the local processing unit is configured to display a list of a group of golfers scores who played a last round of golf with the player entering the score.

44. A method for providing peer review information, comprising:

providing a local processing unit having code to calculate handicap indexes and a display screen;

entering a score of a golfer into the local processing unit for a completed round of golf;

computing with the local processing unit an updated handicap index for the golfer based at least in part on the entered score; and automatically scrolling recently posted scores of other golfers across the display screen to permit peers of the golfers to review the golfer's posted scores.

45. A method as in claim 44, further comprising touching a name of one of the golfers being scrolled across the display screen to display on the display screen scoring information from which a handicap index for the golfer was computed.

* * * * *